US007500506B2

(12) United States Patent
Bohlen et al.

(10) Patent No.: US 7,500,506 B2
(45) Date of Patent: Mar. 10, 2009

(54) SPINDLE-TYPE HOLDER FOR A VERTICAL BLIND VANE

(75) Inventors: Jorg Bohlen, Langen (DE); Konrad Welfonder, Bremerhaven (DE)

(73) Assignee: Hunter Douglas Industries BV, El Rotterdam (NL)

( * ) Notice: Subject to any disclaimer, the term of this patent is extended or adjusted under 35 U.S.C. 154(b) by 422 days.

(21) Appl. No.: 11/315,957

(22) Filed: Dec. 22, 2005

(65) Prior Publication Data

US 2007/0107855 A1 May 17, 2007

(30) Foreign Application Priority Data

Jan. 11, 2005 (EP) ..... 05075058

(51) Int. Cl.
*E06B 9/36* (2006.01)

(52) U.S. Cl. ..... 160/178.1 V; 160/177 V; 403/118

(58) Field of Classification Search ..... 160/177 V, 160/176.1 V, 168.1 V, 173 V, 172 V, 178.1 V, 160/900, 115; 403/118, 109.4, 44, 45
See application file for complete search history.

(56) References Cited

U.S. PATENT DOCUMENTS

| | | | | |
|---|---|---|---|---|
| 1,651,777 | A * | 12/1927 | Peck | 279/90 |
| 1,934,910 | A * | 11/1933 | Buhr | 279/105.1 |
| 2,708,144 | A * | 5/1955 | Carr | 403/108 |
| 5,358,524 | A * | 10/1994 | Richelsoph | 623/23.47 |
| 6,000,456 | A | 12/1999 | Neverett | |
| 2006/0151131 | A1 * | 7/2006 | Bohlen et al. | 160/177 V |
| 2007/0107855 | A1 * | 5/2007 | Bohlen et al. | 160/178.1 V |

* cited by examiner

*Primary Examiner*—Blair M. Johnson
(74) *Attorney, Agent, or Firm*—Dorsey & Whitney LLP

(57) ABSTRACT

A vertically adjustable holder for interconnecting a carrier in a control system for a vertical vane covering for an architectural opening and a suspended vane includes two component parts which are rotatably adjustable relative to each other to increase or decrease the length of the holder and thus the spacing between the carrier and the suspended vane.

12 Claims, 4 Drawing Sheets

SPINDLE-TYPE HOLDER FOR A VERTICAL BLIND VANE

CROSS REFERENCE TO RELATED APPLICATION

This application claims priority to European patent application No. 05075058.7, filed 11 Jan. 2005, which is hereby incorporated by reference as if fully disclosed herein.

BACKGROUND OF THE INVENTION

1. Field of the Invention

This invention relates to a holder for a vane of a vertical venetian blind assembly used, for instance, for covering an architectural opening, such as a window or door.

2. Description of the Related Art

Vertical venetian blinds have generally been provided with horizontally-extending head rails, holding a plurality of carrier or travellers that can be moved in spaced apart relationship along the longitudinal length of each head rail. Each carrier has typically supported a vertically-extending louver, slat or vane by a vane holder in such a manner that the user of the vertical blind can move the vane along the length of the head rail (e.g. by pulling on a first operating cord or pull cord) and also can rotate or tilt the vane about its vertical axis (e.g. by pulling on a second operating cord or tilt cord). For this purpose, each carrier has typically included a main body with a vertically oriented drive hub or worm wheel, which is drivingly connected to a worm gear. The bottom of each drive hub has supported a depending vane holder, adapted to hold securely the top of a vane. A horizontally-extending tilt rod or drive shaft has been provided in the head rail, extending through the carriers and engaging their worm gears, whereby rotation of the tilt rod about its longitudinal axis has caused the drive hubs of the carriers to rotate about their vertical axes so as to make the vane holders and the attached vanes tilt together.

A problem in mounting a vertical venetian blind in a slanted or sloped architectural opening is that, for each slope angle, different vane holders are required. Specifically, a suitable length has to be chosen for each related slope under which the blind is mounted, since the length of the vane holder influences the space the vane of the blind has for rotating and thus tilting. The steeper the slope, the longer the vane holder has to be. When the vane holder is too short, the upper marginal portion of the vane hits the head rail when rotated. When the vane holder is too long, it negatively influences the look of the blind, because light will leak into the room even when the blind is closed. Generally, a blind manufacturer will offer a limited number of different length vane holders. For slopes that are not covered in the assortment of vane holders, a compromise can be made by using a vane holder of a length that comes closest to the ideal one. So in practice, vane holders of a specific length will be used for a range of slope angles. This is not ideal and will lower the quality of the product. The same problem occurs with blinds that are to be mounted in arched or curved architectural openings.

U.S. Pat. No. 6,000,456 solves a different problem, based on a difficulty that can be encountered when mounting a vertical blind assembly adjacent an architectural opening. In particular, where the vanes of the vertical blind assembly are of a particular length, it is necessary that the head rail is positioned and mounted accurately relative to the architectural opening. If the head rail is mounted too high or too low, it becomes necessary to remount it, possibly causing undesirable damage to the architectural opening surrounding. As a solution to this problem, U.S. Pat. No. 6,000,456 proposes a vane holder having an adjustable length. The vane holder has a vane clasp and a clasp holder, the vane clasp having a first end, to which the vane of the blind is attached, and a second end which can be attached to the clasp holder. The holder, in turn, can be attached to a carrier of a vertical blind. The second end of the clasp has ratchet grooves, each of which can co-operate with a single locking tooth in the holder, such that a resilient ratchet-type mechanism is created. The clasp can be moved resiliently between engaging consecutively one of the securing points or ratchet grooves to the locking tooth in the holder so as to vary the height of the vane.

The length adjustable vane holders of U.S. Pat. No. 6,000,456 could theoretically solve the problem of for sloped vertical blinds. Unfortunately, this is not the case since such holders were originally designed only for correcting small inconvenient differences in length. Also a drawback of the adjustable ratchet of such holders is that it is difficult to control their adjustment. In order to overcome the connection between the operably engaged ratchet parts of these holders, one generally has to pull on them, but it is not uncommon that too much force is used and thereby the desired length of the holders is exceeded. This is because the correct amount of force is difficult to control.

SUMMARY OF THE INVENTION

In order to provide an adjustable length holder that can support a vane from a carrier of a vertical blind assembly and that can be more easily and reliably adjusted, the holder of this invention comprises:

- a length adjustable mounting extending from a top end connectable to the carrier to a bottom end connectable to a hook member for suspending the vane,
- the length adjustable mounting comprising a first part and a second part which are operably interconnected to allow displacement of the two parts upwardly or downwardly relative to each other, by which the vertical length of the vane holder between the top end and the bottom end can be adjusted, the first and second parts being rotatably interconnected such that the rotation of one of the first or second parts relative to the other of the first or second parts results in the adjustment of the vertical length of the vane holder.

Advantageously, the first part comprises one of a threaded spindle element or a spindle nut and the second part comprises the other of a threaded spindle element or a spindle nut and wherein the spindle thread and the nut thread are rotatably interconnected. It is especially advantageous that the threaded spindle comprises an elongated body with an outer surface having a screw thread and wherein the spindle nut comprises a nut body with an inner surface having a screw thread.

Also advantageously, the bottom end of the vane holder is rotatable relative to the top end of the vane holder. It is especially advantageous that: the first part comprises a threaded spindle element forming the top end of the holder and the second part comprises a spindle nut forming the bottom end of the vane holder and wherein the threaded spindle element and spindle nut are rotatably interconnected and rotation of the spindle nut causes the nut and the bottom end of the vane holder to move vertically; or the first part comprises a spindle nut which forms the top end of the vane holder and wherein the second part comprises a threaded spindle element which forms the bottom end of the vane holder and wherein the threaded spindle element and the spindle nut are rotatably interconnected and rotation of the spindle nut causes the threaded spindle element and the bottom end of the vane holder to move in a vertical direction towards or away from the top end of the vane holder.

Advantageously, a locking arrangement is provided between the top end and the bottom end of the vane holder which, in a locked position, prevents inadvertent rotation of the bottom end relative to the top end. It is especially advantageous that the locking arrangement comprises a vertically extending groove in the thread of the spindle element and a locking pin that is on the inner surface of the spindle nut and that can cooperate with the groove such that at one point in every 360 degree rotation of the bottom end relative to the top end, the locking pin lodges in the groove to lock the spindle element and spindle nut.

BRIEF DESCRIPTION OF THE DRAWINGS

Further aspects of the invention will be apparent from the following description and the accompanying drawings, in which.

DETAILED DESCRIPTION OF THE PREFERRED EMBODIMENTS

Figure 1:
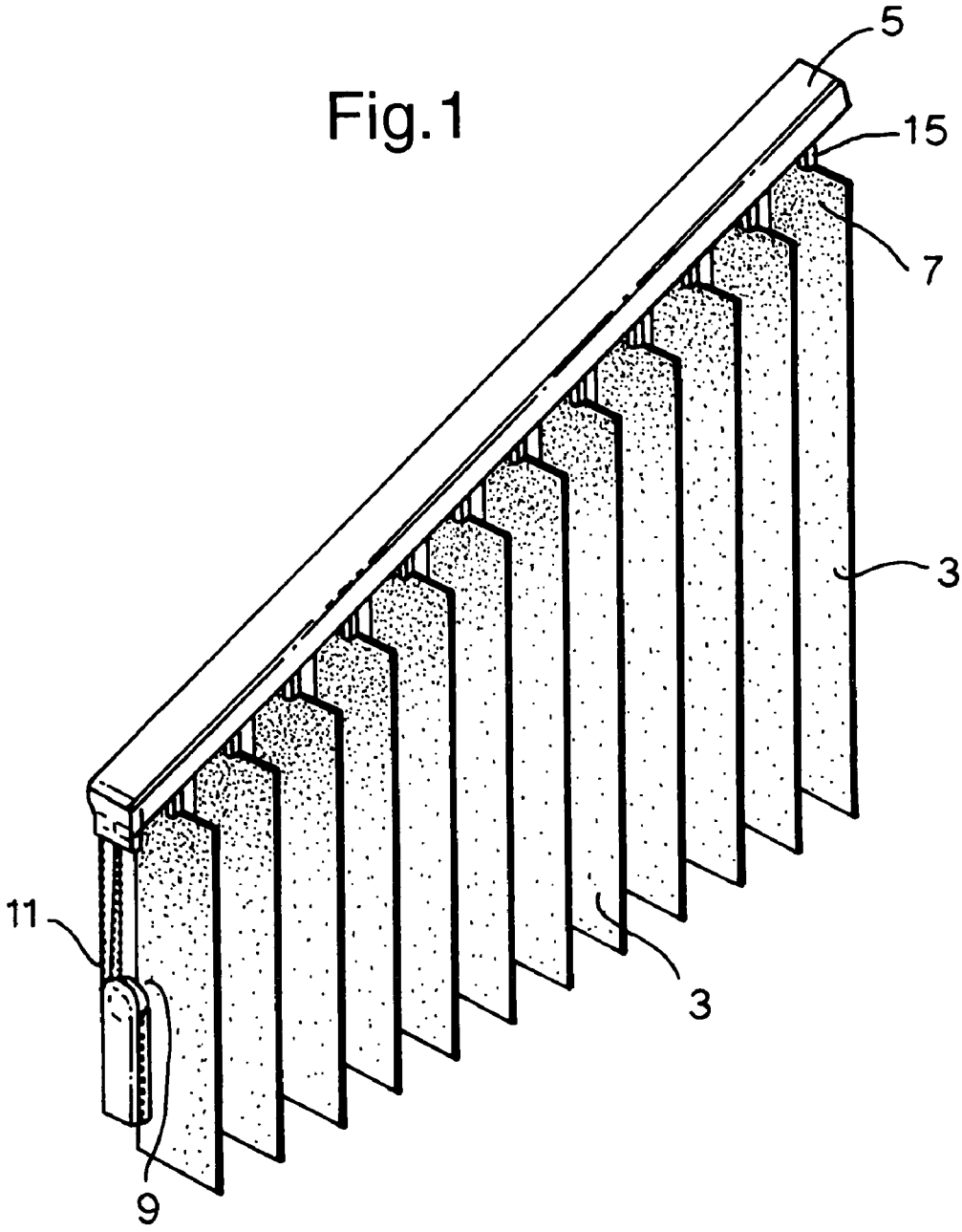
FIG. 1 is a perspective view of a vertical blind assembly including a vane holder of this invention.

FIG. 1 shows a vertical blind assembly 1 which includes a plurality of vertical vanes or louvers 3 suspended from a generally longitudinally-extending head rail 5 that is mounted at an upward slope or angle (from left to right in FIG. 1). The vanes 3 may be conventional metal, plastic or fabric slats, each having an upper marginal portion 7 securely suspended vertically from a holder 15. Each holder is attached to a conventional carrier or traveller (not shown) that extends downwardly for, is carried by, and can be moved longitudinally along, the head rail 5.

As shown in FIG. 1, the head rail 5 may also be provided with a conventional pull cord 9 for moving a plurality of the carriers along the head rail and a conventional bead chain 11 which serves as a tilt cord for rotating a grooved tilt rod (not shown) of the head rail 5 so as to tilt the vanes 3.

Figure 2:
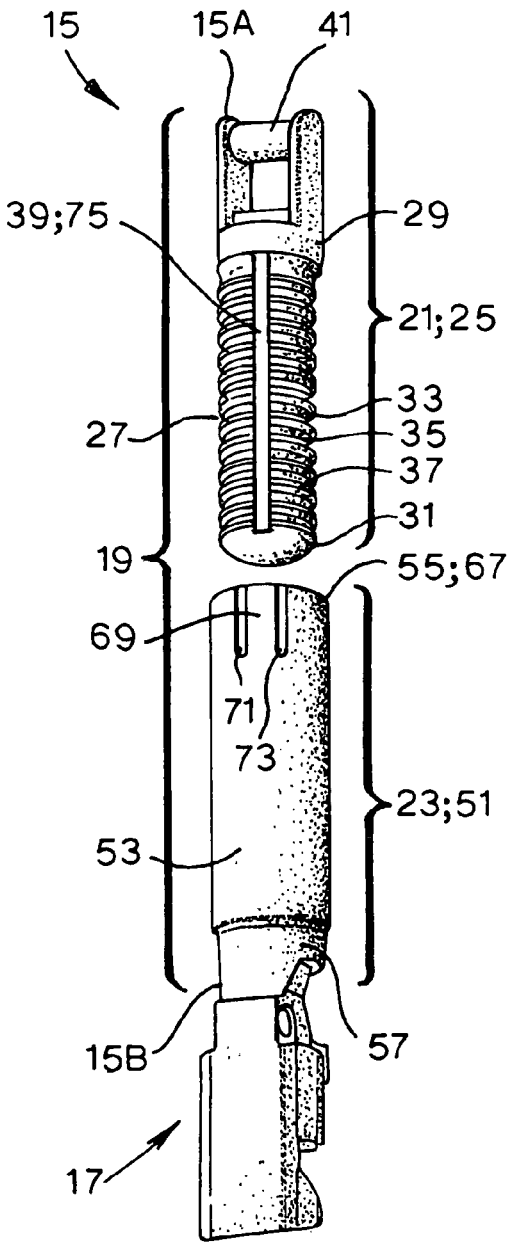
FIG. 2 is an exploded perspective view of a first embodiment of the vane holder of the invention.

FIG. 2 shows the vane holder 15 with a carrier 13, which can be carried by the head rail 5. The vane holder 15 has a top end 15A that is connectable to the carrier, a bottom end 15B which carries a hook member 17, and a length adjustable mounting 19 which provides the possibility of changing the vertical length of the vane holder between the top end 15A and the bottom end 15B. The length adjustable mounting 19 includes a top or first part 21 forming the top end 15A of the holder 15 for attachment to the carrier 13 and a bottom or second part 23 forming the bottom end 15B of the holder 15 for carrying a hook member 17. The first part 21 has a threaded spindle element 25, and the second part 23 has a threaded spindle nut 51 carrying the hook member 17, so that the two parts can be displaced vertically relative to one another.

As shown in FIG. 2, the first part 21 of the length adjustable mounting 19, which includes the threaded spindle element 25, includes an elongated body 27 with a top base 29 a bottom base 31 and a threaded outer surface 33. The threaded outer surface 33 has a circumferential screw-thread 35 of multiple windings 37. Extending from the top base 29 vertically down to the bottom base 31 of the outer surface 33 is a groove 39. The groove cuts through the windings 37 of the thread 35 and is part of a locking arrangement 75 which is explained further below. Extending upward from the top base 29 is a connector 41 for attachment to the carrier 13; for sloped blinds, the attachment of the vane holder 15 to the carrier 13 is preferably by a conventional intermediate gimbals mounting (not shown).

The second part 23 of the length adjustable mounting 19, which includes the spindle nut 51, is suitable for carrying the hook member 17. The spindle nut 51 has an elongated body 53 with a top base 55, a bottom base 57 and a threaded inner surface 59 (not visible). The threaded inner surface 59 has a circumferential screw-thread 61 (not shown) of multiple windings 63 (not shown).

As also shown in the FIG. 2, the spindle nut 51 is vertically at least as long as, and preferably longer than, the threaded outer surface 33 of the spindle element 25. The vertical lengths of the nut 51 and the spindle element 25 determine the maximum possible vertical length of the vane holder 15 which is reached when the top base 55 of the nut 51 is at the bottom base 31 of the spindle element 25. Means for preventing the disengagement of the parts 21, 23 at this point can be provided, such as by closing the last thread winding on the bottom base 31 of the spindle thread 35 or the last thread winding on the top base 55 of the nut thread 61 or both.

In accordance with the invention, the spindle element 25 and the nut 51 are operably interconnected in that the nut 51 is rotatably placed about spindle element 25 and the nut thread 61 co-operates with the spindle thread 35. In use rotation of the nut relative to the spindle results in a vertical displacement of the bottom end 15B and the hook member 17 it carries either towards or away from the top end 15A of the vane holder, depending on the type i.e. left or right handed screw-threads that are chosen. At the same time rotation of the nut 51 will also rotate the hook member 17 and change its orientation relative to the threaded spindle 21, relative to the top of the vane holder 15A and when the vane holder 15 is installed in a blind also relative to the carrier 13. Thus in practice when the desired length of the vane holder is determined and even when the vane holder is assembled into a vertical venetian blind, only rotations of integers of 360 degrees can than be used to adjust the vertical position of the hook member. Rotations of less then 360 degrees would be unacceptable since they would change the angle of the hook member relative to the top end of the vane holder, while a change of the angle of the hook member should only be a direct result of the normal tilting action and only relative to the carrier to which the vane holder is attached. The length resulting from the adjustment per 360 degree turn, depends on the pitch of the thread of the spindle and nut. The length of the vane holder 15 and the vertical position of the hook member 17 relative to the top end 15A of the vane holder 15 can thus be adjusted.

Figure 3:
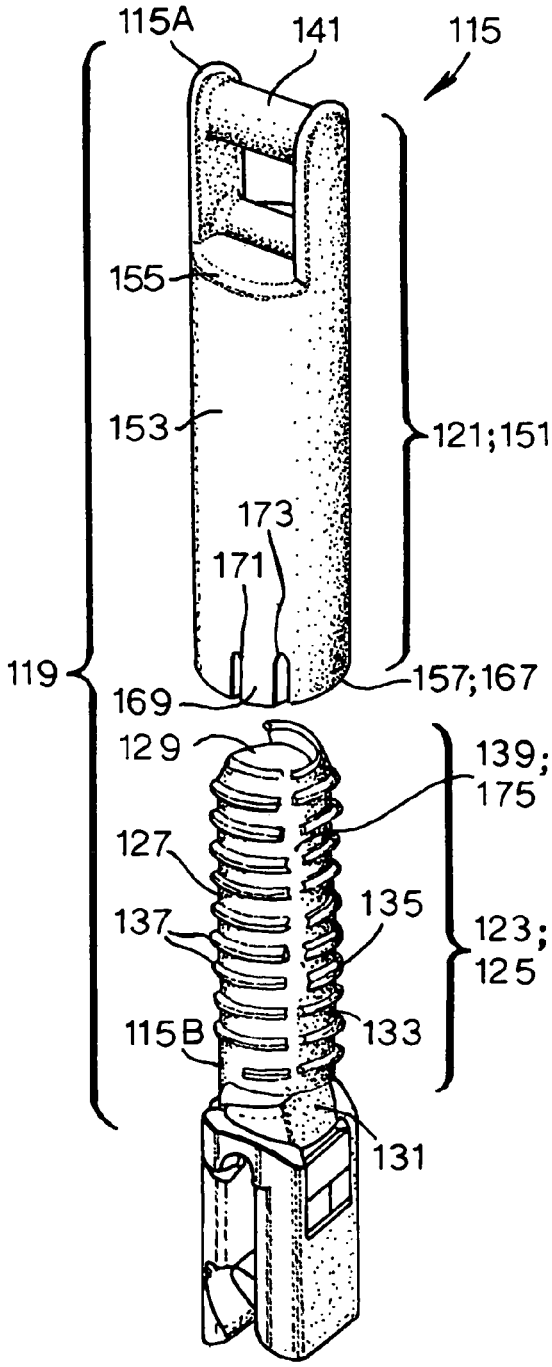
FIG. 3 is an exploded perspective view of a second embodiment of the vane holder of the invention.

FIG. 3 shows a second embodiment 115 of the adjustable length holder of the invention which is similar to the holder 15 of FIGS. 1-2 and for which corresponding reference numerals (greater by 100) are used below for describing the same parts or corresponding parts.

The vane holder 115 has a top end 115A that is connectable to the carrier, a bottom end 115B which carries a hook member 117, and a length adjustable mounting 119 which provides the possibility of changing the length of the vane holder between the top 115A and the bottom 115B. The length adjustable mounting 119 of the second embodiment also comprises two-parts including a first part 121 having a top 115A for attachment to the carrier and a second part 123 having the bottom 115B for carrying a hook member 117. The first and second parts 1211, 123 can be displaced vertically relative to each other.

As shown in FIG. 3, the first part 121 has a spindle nut 151 which includes an elongated nut body 153 with the top nut base 155, the bottom nut base 157 and a the nut thread 161 on the inner surface 159 (not shown). The nut thread 161 comprises multiple windings 163 (not shown). Extending upward from the top nut base 155 is a connector 141 for attachment to the carrier 113 (not shown); for sloped blinds preferably attachment to the carrier 113 is preferably realized by an intermediate gimbals mounting (not shown).

The second part 123 includes a threaded spindle element 125 and carries a hook member 117. The threaded spindle element 125 comprises an elongated body 127 with a top base 129 a bottom base 131 and a threaded outer surface 133. The threaded outer surface 133 comprises a circumferential screw-thread 135 of multiple windings 137. Extending from the top base 129 vertically down to the bottom base 131 of the outer surface is a groove 139. The groove cuts through the windings 137 of the thread 135, and is part of a locking arrangement 175 between the spindle and the nut of the adjustable mounting 119 which is explained further below. The spindle thread 135 is of course chosen to co-operate with the nut thread 161.

As also shown in the FIG. 3, the spindle nut 151 is vertically, at least as long as, and preferably longer than, a threaded outer surface 133 of the spindle element 125. The length of the nut 151 and the spindle element 125 determine the maximum possible length of the vane holder 115 which is reached when the bottom or free base 167 of the nut 151 is at the base 129 of the spindle element 125. Means for preventing the disengagement at this point can be added such as closing the last thread winding on the top base 131 of the spindle thread 135 or the last thread winding on the free base 167 of the nut thread 161 or both.

In use, the first part 121 which includes the nut 151, and the second part 123 which includes the spindle element 125 are operably interconnected in that the spindle element 125 is rotatably placed within the nut 151. Rotation of the spindle element 125 relative to the nut 151 results in a vertical displacement of the bottom 115B and the hook member 117 it carries either towards or away from the top 115A of the vane holder. At the same time rotation of the spindle element 125 will also rotate the hook member 117 and change its orientation relative to the threaded nut 151, the top of the vane holder 115A and the carrier 113. Thus, as in the first embodiment, in practice when realizing the desired length for the vane holder 115 and or adjusting it even when the vane holder 115 is assembled into a vertical venetian blind, integers of 360 degree rotations can than be used to adjust the vertical position of the hook member.

In the vane holders 15 and 115 of FIGS. 1-3, a locking arrangement 75, 175 is provided to ensure that during normal tilting action each vane holder 15,115 rotates as a single unit, and thus prevents the threaded parts 25, 51, 125, 151 of the adjustable mountings 19, 119 from inadvertently rotating relative to each other during the normal tilting action, which could result in an undesired vertical displacement of the hook member 17, 117 as well as an undesired radial lagging behind the desired tilt. The locking arrangement is provided between the threaded spindle element 25,125 and the nut 51,151 to prevent this undesired displacement and ensures rotation of the vane holder 15,115 during normal tilting as single body. The locking arrangement 75,175 comprises the vertically extending groove 39,139 in the thread 35,135 of the threaded spindle element 25,125, and a lock pin 65,165 (not shown) on the inner surface 59,159 of the threaded nut 51,151 at a free base 67, 167 of the nut body 53, 153. The free base 67,167 is the top nut base 55 in the first embodiment and the bottom nut base 157 in the second embodiment. The lock pin 65,165 (not visible) provides a locking action in the groove 39,139 such that during normal tilting the vane holder 15,115 acts as a single body.

For initially choosing and adjusting to the desired length of the vane holder 15,115 or for adjusting the length later, relative easy un-locking of the lock pin 65,165 from the groove 39,139 is realized by the lock pin being positioned on a relative flexible leg 69,169 of the nut body 53,153. The leg portion 69,169 is realized between two parallel, adjacent slits 71,73; 171,173 in the nut body 53,153. When the hook member 17,117 is rotated relative to top 15A, 15A of the vane holder 15,115, the flexible leg portions 69,169 of the nut 51,151 flexes outward and the latch pin 65,165 disengages from the groove 39,139 of the spindle element 25,125.

Figure 4:
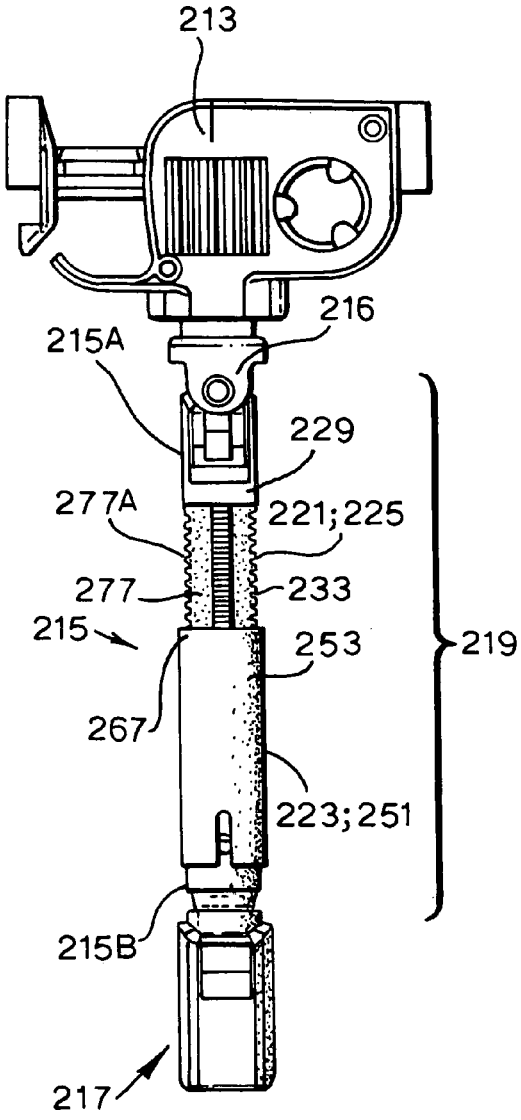
FIG. 4 is a plan view of a fourth embodiment of the vane holder of the invention, attached to a carrier.
Figure 5:
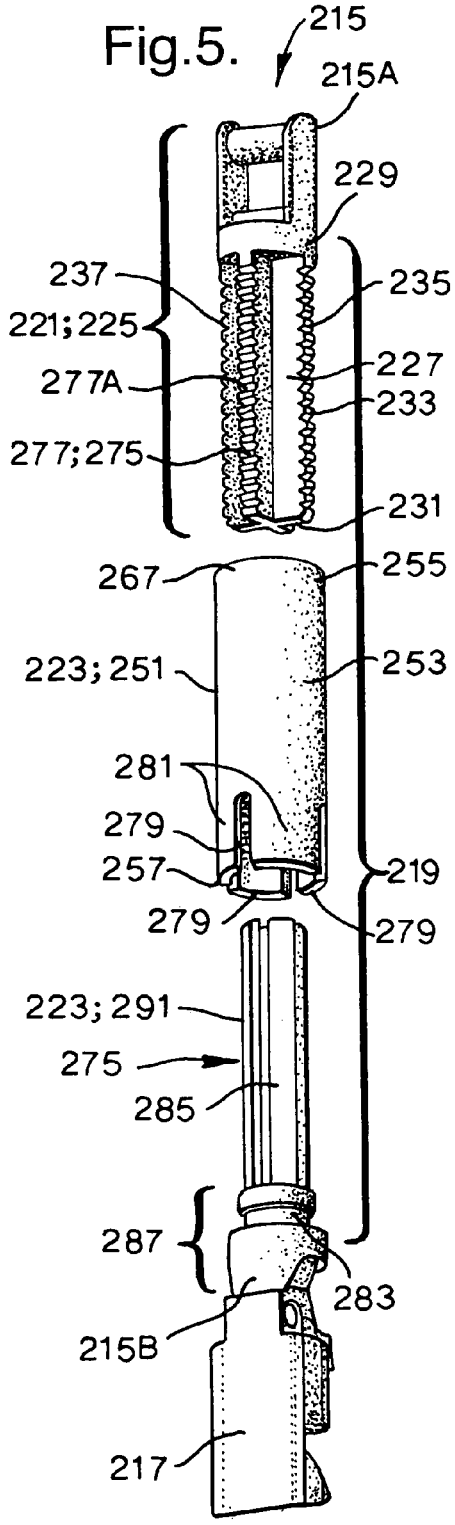
FIG. 5 is an exploded perspective view of the third embodiment of the vane holder of the invention.

FIGS. 4 and 5 show a preferred, third embodiment 215 of the adjustable length holder of the invention which is similar to the holder 15 of FIGS. 1-2 and for which corresponding reference numerals (greater by 200) are used below for describing the same parts or corresponding parts.

The vane holder 215 can be vertically adjusted between the top and bottom ends 215A, 215B without affecting the radial orientation of the bottom end 215B and hook member 217 relative to the top end 215A. Thus, this arrangement allows length adjustment by rotational movement of the second part 223 of the length adjustable 219 mounting relative to the first part 221 by less than 360 degree turns. This means that a more precise length adjustment can be realized.

FIG. 4 shows a carrier 213 with the vane holder 215. The connection of the vane holder 215 to the carrier 213 can be of any desired arrangement for suspending the vane holder. FIG. 4 shows a preferred gimbals mounting 216 for connecting the vane holder to the carrier in a sloped blind.

The vane holder 215 has a top end 215A that is connectable to the carrier 213, a bottom end 215B which is suitable for connection to a hook member 217, and a length adjustable mounting 219 which provides the possibility of changing the vertical length of the vane holder between the top 215A and the bottom 215B. The length adjustable mounting 219 includes a top or first part 221 comprising the top 215A for attachment to the carrier 213 and a bottom or second part 223 comprising the bottom 215B for connection to the hook member 217, and these parts can be displaced relative to each other.

As shown in FIG. 4, the top part 221 of the length adjustable mounting 219 has a threaded spindle element 225 and the bottom part 223 comprises a threaded spindle nut 251 carrying the hook member 217. The spindle element 225 and the nut 251 are operably interconnected in that the nut 251 is rotatably placed about spindle element 225. The top part 221, which has the threaded spindle element 225, includes an elongated body 227 with a top base 229, a bottom base 231 and a threaded outer surface 233. The body 227 further has a plurality of outwardly extending wings 277. The wings extend radially outwards from the vertical axis of the body 227 and are part of a locking arrangement 275. Each of the radial or locking wings 277 ends in an outer surface 277A. The outer surfaces 277A of the wings 277 together shape the circumferential, discontinuous outer surface 233 of the spindle element 225 and comprise the spindle thread 235. The spindle thread 235 has multiple windings 237.

The bottom part 223 has the spindle nut 251 and a nut holder 391, and the nut 251 is rotatably mounted on a nut holder 291, which in turn carries the hook member 217. The spindle nut 251 comprises an elongated body 253 with a top base 255 a bottom base 257 and a threaded inner surface 259. The threaded inner surface 259 comprises a circumferential screw-thread 261 of multiple windings 263.

The nut holder 291 comprises a bottom base 287 and at least one locking arm 285. The bottom base 287 coincides with the bottom end 215B of the vane holder. The bottom base 287 comprises a circumferential channel portion 283 and the at least one locking arms 285 extends vertically upwardly from the bottom base 287. When there are more than one locking arms, they are parallel and spaced apart on the bottom base 287. The channel portion 283 is a circumferential waist like portion. The nut holder bottom base 287 extends outwardly in circumferential direction beyond the channel portion 283 both above and below it. The at least one locking arm 285 thus extends upwardly from above the channel portion 283. The locking arms 285 each have an outer surface 285A which together form a circumferential, discontinuous outer surface 297 of the nut holder 291 which is smooth and not threaded. The threaded nut 251 is mounted about the locking arms 285 of the nut holder 291, and is rotatable about the circumferential, discontinuous outer surface 297 of the nut holder 291. The at least one locking arm 285 of the nut holder 291 is part of a locking arrangement 275 which prevents rotation of bottom end 215B of the vane holder and of the hook member 217 it carriers relative to the top end 215A of the vane holder. The locking arrangement 275 is described further below.

The nut 251 of the third embodiment further comprises at the bottom nut base 257 of the cylindrical nut body 255, at least one radially inwardly projecting flange portion or foot 279 for attachment to and rotatable co-operation with the circumferential channel portion 283 on bottom base 287 of the nut holder 291. The bottom nut base 257 of the cylindrical nut body 255 can additionally be provided with a number of slits, dividing the body into a plurality of lower legs 281, each including one of the inwardly projecting feet 279, that can flex slightly in and out for assembly to the circumferential channel portion 283 on the nut holder bottom base 291. Since as described above the hook member 271 is carried by the nut holder bottom base 287, which coincides with the bottom end 215B of the vane holder, the nut 251 when assembled to the nut holder 291 carries the hook member 217 while being rotatable relative to the hook member 217. As in the previous embodiments the nut thread 261 is of course chosen to co-operate with the spindle thread 235.

The locking arrangement 275 comprises the at least one locking arm 285 on the nut holder 291 in slidable co-operation with the at least one locking wing 277 of the threaded spindle 223. Adjacent radial wings 277 of the spindle body 227 are at angles to each other, such that between each pair of adjacent radial wings one locking arm 285 can be slidingly accommodated. The locking arm 285 of the locking arrangement 275 does not project radially beyond the outer radial wing surfaces 277A or outer spindle surface 233 of the spindle element 225 and does not hinder rotation of nut 251 relative to the spindle element 225. This arrangement of the co-operating locking arms with the wings prevents the rotation of the bottom end 215B relative to the top end 215A of the vane holder 215 and ensures that the vane holder 215 once assembled into a vertical venetian blind acts as a single element during operation of the blind.

In the third embodiment of the vane holder 215 there are four locking wings 277 on the spindle body 227 and four locking arms 285 on the nut holder 291. The arms are spaced apart along in a general circular manner. The locking arms 285 are preferably of the same length as the nut 251 to ensure operation of the locking arrangement in any length of the vane holder 215. If the locking arms where shorter than the nut 251 they could at a certain length of the vane holder be disengaged from the locking wings 277 of the spindle element 225 rendering the locking arrangement inoperable.

As shown in the FIGS. 4 and 5, the spindle nut 251 is at least as long as or longer than the threaded outer surface 233 of the spindle element 225. The length of the nut 251 and the spindle element 225 determine the maximum possible length of the vane holder 215 which is reached when the top or free base 255,267 of the nut 251 is at the bottom base 231 of the spindle element 225. Means for preventing the disengagement at this point can be added, preferred it to close the last thread winding 263 (not visible) at the free base 267 of the nut 251.

When assembled, the adjustable mounting 219 comprises as top part 221 the threaded spindle element 225 and as bottom part 223 the nut 251 and the nut holder 291. The hook member 217 is carried by the nut holder 391 as part of the bottom part 223 of the adjustable mounting 219. The spindle nut 251 is rotatably mounted relative to the hook member 217 by the inwardly projecting flange 279 to the channel portion 283 on the nut holder 291 and relative to the threaded spindle element 225 by the connection between the nut thread and the spindle thread. The locking arrangement 275 between the hook member 217 and the spindle element 225, including at least one locking arm 285 of the nut holder 391 in sliding co-operation and between two adjacent locking wings 277 of the spindle element 225, ensures that the vane holder 215 rotates as a single element when it is mounted in a vertical blind assembly and during normal tilting of the vanes of the vertical blind assembly. The spindle nut 251 is rotatably placed about the outer surface of the spindle element 225, and at the same time about the locking arms 285.

In use, when the length of the vane holder 215 is chosen and set or needs to be adjusted, the nut 251 is rotated in clockwise or counter clockwise direction. This clockwise or counter clockwise rotation of the nut 251 translates into an upward or downward movement of the nut 251 relative to the spindle 223 depending on the sort of thread that is used. The upward or downward movement of the nut 251 directly causes an identical vertical movement of the hook member 217 because of the connection of nut 251 by the inwardly projecting flange 279 to the channel portion 283 on the nut holder 291. Thus by rotation of the nut 251 the length of vane holder 215 between the top 215A and the bottom 215B reduces or increases, and the vertical position of the hook member 217 relative the top 215A of the vane holder 215 is changed. The radial orientation of hook member 217 relative to the top 215A of the vane holder remains unchanged due to rotational connection between the nut 251 and the hook member 217 and the due to locking arrangement 275 which prevents rotation of the hook member 217 relative to the spindle element 225.

Figure 6:
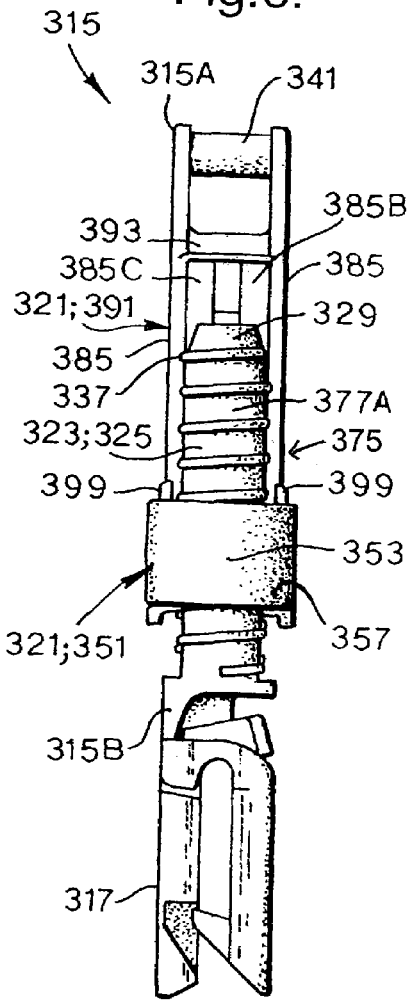
FIG. 6 is a plan view of a fourth embodiment of the vane holder of the invention.
Figure 7:
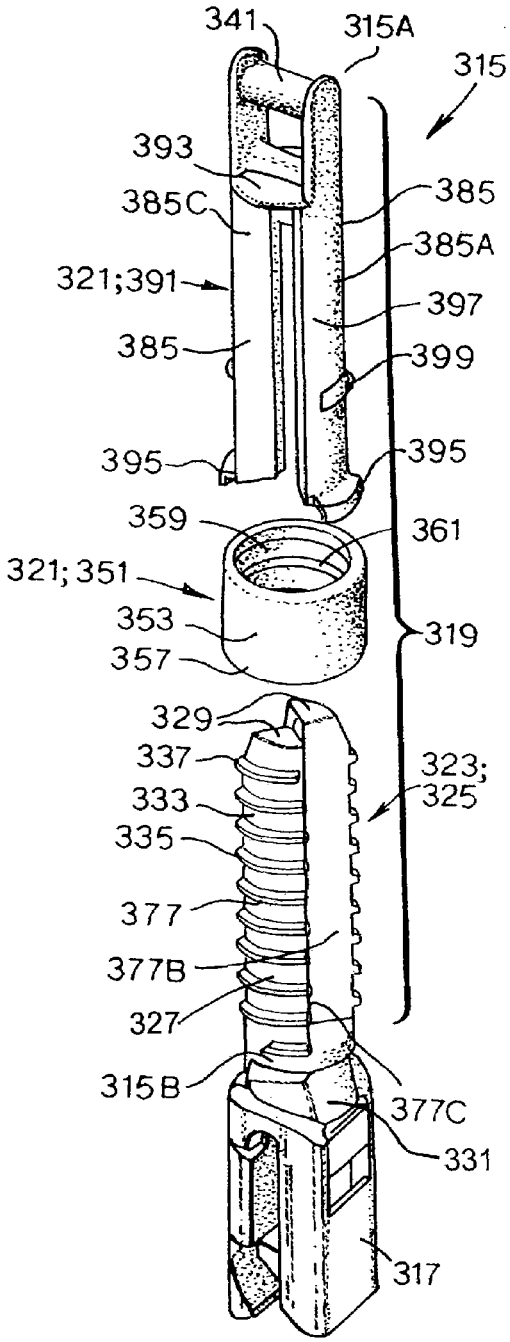
FIG. 7 is an exploded perspective view of the fourth embodiment of the vane holder of the invention.

FIGS. 6 and 7 show a preferred, fourth embodiment 315 of the adjustable length holder of the invention which is similar to the holder 15 of FIGS. 1-2 and for which corresponding reference numerals (greater by 300) are used below for describing the same parts or corresponding parts. The vertical length of the vane holder 315 can be adjusted between the top and bottom 315A, 315B without effecting the radial orientation of the hook member 317.

The vane holder 315 has a top end 315A that is connectable to a carrier (not shown), a bottom end 315B which is suitable for connection to a hook member 317, and a length adjustable mounting 319 which provides the possibility of changing the vertical length of the vane holder between the top 315A and the bottom 315B. The length adjustable mounting 319 includes a top or first part 321 comprising the top end 315A of the vane holder 315 for attachment to a carrier and a bottom or second part 323 comprising the bottom end 315B of the vane holder 315 for connection to the hook member 317, and the two-parts can be displaced relative to each other.

The top part 321 has a spindle nut 351, and the bottom part 323 has a threaded spindle element 325 carrying the hook member 317. The spindle element 325 and the nut 351 are operably interconnected in that the nut 351 is rotatably placed about spindle element 325. The top part 321 also has a nut holder 391 on which the nut 351 is rotatably mounted. The nut holder 391 includes a top base 393, one or more parallel and spaced apart vertically locking arms 385 extending vertically downwardly from the top base 393 and ending in a bottom base 395. The nut holder 391 and the locking arms 385 are part of a locking arrangement 375 which prevents rotation of the bottom end 315B of the vane holder and of the hook member 317 relative to the top end 315A of the vane holder. The locking arms 385 each have an outer surface 385A which together form a circumferential, discontinuous outer surface 397 of the nut holder 391 which is smooth and not threaded. The threaded nut 351 is mounted about the locking arms 385 of the nut holder 391, and is rotatable about the circumferential, discontinuous outer surface 397 of the nut holder 391. The bottom base 395 of each locking arms 385 has outwardly flared edges preventing the nut 351 from detaching from the nut holder. Extending upwardly from the top base 393 of nut holder 391 is a connector 341 for connection of the vane holder 315 to a carrier.

The nut 351 includes a cylindrical nut body 353 which is shorter in length then the spindle element 325 and having an outer surface 354 and an inner surface 359. The inner nut surface 359 comprises a screw thread 361 of multiple windings 365. The nut body 353 can be cylindrical with a smooth or knurled outer nut surface 352 or it can be hexagonal.

The bottom part 323 of the length adjustable mounting 319 has the threaded spindle element 325 and is suited for carrying the hook member 317. The threaded spindle 323 includes an elongated body 327 with a bottom base 331 which carries the hook member 317. The spindle body 327 is in the shape of two parallel vertically locking wings 377 extending upwardly from bottom spindle base 331. Each spindle locking wing 377 having with a top base 329 and a threaded outer surface 377A. The threaded outer surfaces 377A of both wings 377 together form a circumferential but discontinuous outer surface 333 of the spindle, with a circumferential but discontinuous spindle thread 335 of multiple windings 337.

The locking arrangement 375 has at least one locking wing 377 on the hook member 317 that is in slidable co-operation with at least one locking arm 385 of the nut holder 391. Adjacent locking wings 377 of the spindle element 325 are at angles to each other, such that between the adjacent locking wings 377 one locking arm 385 can be slidingly accommodated. The locking wings 377 of the locking arrangement 375 project radially beyond the outer radial arm surfaces 385A of the nut holder 391 and its outer threaded surface 333 provides a suitable connection with the inner threaded surface 359 of the nut 351. The at least one locking wing 377 is fixedly connected to the hook member 317. It extends from a top hook base 387 of the hook member 317. In the fourth embodiment of the vane holder 315 there are two locking arms 385 on the nut holder 391 and two locking wings 377 on the hook member 217.

The cross-sectional shapes of both the locking wings 377 and the locking arms 385 and their relative positions on the top hook base 387 and the top nut holder base 393 are chosen to allow a slidable interaction between the nut holder 391 and the spindle element 325. As can be best seen in FIG. 7, the locking wings 377 of the spindle element 325 and the locking arms 385 of the nut holder 391 have a general pie-point shaped cross-section. The wings and arms having a outer curved wall 377A, 385A and left and right inner walls 377B, 377C,385B,385C projecting radially inwards. The locking wings 377 are placed relative to each other at certain angles, such that between the two wings 377 between opposite inner walls 377B, 377C one of the locking arms 385 can be accommodated. This arrangement of the co-operating locking arms with the wings prevents the rotation of the bottom end 315B relative to the top end 315A of the vane holder 315 and also ensures that the vane holder 315 once assembled into a vertical venetian blind acts as a single element during operation of the blind.

The locking arms 385 of the nut holder 391 do not project radially beyond the outer circumferential threaded surface 333 of the locking wings 377 of the spindle 323. Ensuring that the inner threaded surface 359 of the nut 351 comprising the nut thread 361 can co-operate with the outer radial threaded surfaces 333 of the spindle 323. As is partly visible in FIG. 7, the inner nut thread 361 comprises a plurality of windings 363.

When assembled, the adjustable mounting 319 comprises as top part 321 the threaded nut 351 and the nut holder 391 and as bottom part 323 the threaded spindle element 325. The hook member 317 is carried by the bottom part 323, the threaded spindle element 325 of the adjustable mounting 319. The spindle nut 351 is rotatably mounted relative to both the nut holder 391 and to the threaded spindle element 325. The locking arrangement 375 between the hook member 317 and the nut holder 391, including the locking arms 385 of the spindle 325 in sliding co-operation with the locking wings 377 of the nut holder 391, prevents rotation of the bottom end 315B and of the hook member 317 relative to the tope end 315A of the vane holder. The spindle nut 351 is rotatably placed about the outer surface of the spindle element 325, and at the same time about the locking wings 377 of the nut holder 391.

As shown in the FIGS. 6 and 7, the spindle nut 351 has a short ring like nut body 353, and the nut holder 391 is at least as long as or longer than threaded outer surface 233 of the spindle element 325. In stead of the nut 351, in this embodiment the length of the nut holder 391 and the length of the spindle element 325 determine the maximum possible length of the vane holder 315. The maximum length is reached when the top base 329 of the spindle element 325 is moved to the bottom base 357 of the nut 351. In this respect the position of the nut 351 nearest the bottom portion 395 on the nut holder 391 is also determinative for the maximum length of the vane holder 315. Means for preventing the disengagement of the spindle element 325 from the nut 351 can be to close the last thread winding 363 (not visible) at the bottom base 357 of the nut 351 or the last thread winding 337 at the top base 329 of the spindle element 325.

In use, when the length of the vane holder 315 is chosen and initially set or when it needs to be adjusted, the nut 351 is rotated in clockwise or counter clockwise direction. This clockwise or counter clockwise rotation of the nut 351 translates into an upward or downward movement of the spindle element 325 and associated hook member 317 depending on whether a right or left handed the thread is used. Thus by rotation of the nut 351 the length of vane holder 315 between the top 315A and the bottom 315B reduces or increases, and the vertical position of the hook member 317 relative the top 315A of the vane holder 315 is also changed. The locking arrangement 375 ensures that radial orientation of hook member 317 relative to the top 315A of the vane holder remains unchanged during adjustment of the length of the vane holder as well as during operation of the blind when it is assembled to a blind.

Additionally, to prevent inadvertent vertical sliding displacement of the nut 351 along the nut holder 391, protrusions 399 are placed on the outer surface of the locking wings 377 of the nut holder 391. The protrusions 399 and the bottom flanges 395 of the nut holder 391 confine the nut 351 to its vertical position on the nut holder. Alternatively, the nut 351 can comprise an inner screw thread comprising a single winding instead of a plurality of windings.

All the vane holders 15, 115, 215, 315 include an additional locking arrangement for ensuring that the vane holder will act as a single body during normal tilting operation of the vanes in a blind. The locking arrangement either preventing inadvertent rotation during tilting, or preventing all rotation between the top end and the bottom end of the vane holder. However, other solutions to ensure that the vane holder will act as a single element during tilting are also possible. Such solutions include the choice of a nut thread and a spindle thread that allow relative rotation only by exerting a relative large rotational force on one or both of the parts, e.g. by ensuring a relative high friction between the threads. The force needed for rotation should be significantly larger than the force that would be caused by the normal tilting action. The length of a vane holder of such an embodiment could preferably only be set before assembly into a blind, i.e. during assembly of the various elements of the vane holder. Later length adjustment would be possible but less easily realized and could require dismounting the vane holder from the blind.

Alternatively during assembly of the various elements of the vane holder, the desired length could be set and fixated. The fixation can e.g. be realized by adhesive. The advantage of an easily set length is still there, less parts are still needed because any desired length can be produced by the top and bottom parts of the vane holder elements that are in stock. But once the length is set for a blind that will be mounted under a specific slope, it cannot be adjusted later.

This invention is, of course, not limited to the above-described embodiments which may be modified without departing from the scope of the invention or sacrificing all of its advantages. In this regard, the terms in the foregoing description and the following claims, such as "vertical", "horizontal", "upward", "downward", "upper", "lower", "inward", "outward", "longitudinal" and "lateral", have been used only as relative terms to describe the relationships of the various elements of the spindle-type adjustable length vane holder of the invention. For example, when the vane holder is being assembled or when it is sold as a separate part of a vertical venetian blind, it can be in a generally horizontal position, and the holder in such a position would be within the scope of this invention. Also, the hook member 17,117, 217, 317 can either be integrally formed with the bottom end 15B, 115B, 215B, 315B of the vane holder 15, 115, 215, 315 or it can be connected thereto by any suitable means. The type of hook member is also not critical, so long as it is suited for carrying a vane.

We claim:

1. The combination of a carrier for a vertical vane covering for an architectural opening, a vane used in the covering and a vane holder that can support the vane from the carrier, said combination comprising:

a carrier;

a vane; and a vane holder, said vane holder having, a) a length adjustable mounting extending from a top end, connectable to said carrier, to a bottom end, connectable to a hook member for suspending said vane, b) the length adjustable mounting comprising a first part and a second part which are operable interconnected to allow displacement of the two parts upwardly or downwardly relative to each other, by which the vertical length of the holder between the top end and the bottom end can be adjusted, c) characterized in that the first part and the second part are retractably interconnected such that the rotation of one of the first or second parts relative to the other of the first or second parts results in the adjustment of the vertical length of the holder, d) the first part comprises one of a threaded spindle element or a spindle nut, the second part comprises the other of a threaded spindle element or a spindle nut and wherein the threaded spindle element and the spindle nut are retractably interconnected, e) the threaded spindle comprises an elongated body comprising an outer surface which comprises a screw thread and wherein the spindle nut comprises a nut body comprising an inner surface which comprises a screw thread and wherein the spindle thread and the nut thread are retractably interconnected, f) wherein the spindle nut is further retractably mounted about a nut holder such that the nut is Rota table relative to both the top end and the bottom end of the vane holder.

2. The combination of claim 1, wherein the nut holder further comprises at least one locking arm and the spindle element further comprises at least one locking wing, and wherein the at least one locking arm and the at least one locking wing are slidable relative to each other in vertical direction and together form a locking arrangement which prevents any rotational movement of the bottom end relative to the top end of the vane holder.

3. The combination of claim 2, wherein the first part of the length adjustable mounting comprises the threaded spindle element which comprises the top end of the vane holder and wherein the second part of the length adjustable mounting comprises the nut and the nut holder of which the nut holder comprises the bottom end of the vane holder and wherein rotation of the nut causes both the nut and the nut holder and the bottom end of the vane holder to move in a vertical direction towards or away from the top end of the vane holder.

4. The combination of claim 3, wherein the nut rotatably surrounds both the at least one locking arm of the nut holder and the at least one locking wing of the spindle element and the nut thread operably engages the spindle thread which is discontinuous and located on respective outer surfaces of each locking wing of the spindle element, such that rotation of the nut causes both the nut and the nut holder with its at least one locking arm and the bottom end of the vane holder to move in a vertical direction towards or away from the top end of the vane holder whereby the at least one locking arm slides along the at least one locking wing of the spindle element.

5. The combination of claim 2, wherein the first part of the length adjustable mounting comprises the nut and the nut holder of which the nut holder comprises the top end of the vane holder and wherein the second part of the length adjustable mounting comprises the threaded spindle element which comprises the bottom end of the vane holder and wherein rotation of the nut causes both the spindle element and the bottom end of the vane holder to move in a vertical direction towards or away from the top end of the vane holder.

6. The combination of claim 5, wherein the nut rotatably surrounds both the at least one locking arm of the nut holder and the at least one locking wing of the spindle element and the nut thread operably engages the spindle thread which is discontinuous and located on respective outer surfaces of each locking wing of the spindle element such that rotation of the nut causes the spindle element nut with its at least one locking wing and the bottom end of the vane holder to move in a vertical direction towards or away from the top end of the vane holder whereby the at least one locking wing of the spindle element slides along the at least one locking arm of the spindle nut.

7. The combination of claim 1, wherein the first part of the length adjustable mounting comprises the threaded spindle element which comprises the top end of the vane holder and wherein the second part of the length adjustable mounting comprises the spindle nut which comprises the bottom end of the vane holder and wherein the threaded spindle element and the spindle nut are rotatably interconnected and wherein rotation of the spindle nut causes the nut the bottom end of the vane holder to move in a vertical direction towards or away from the top end of the vane holder.

8. The combination of claim 7, wherein a locking arrangement is provided between the top end and the bottom end of the vane holder which in a locked position prevents inadvertent rotation of the bottom end of the vane holder is rotatable relative to the top end of the vane holder.

9. The combination of claims 8, wherein the locking arrangement comprises a vertically extending groove in the thread of the spindle element and a locking pin on the inner surface of the nut for co-operation in the groove such that at one point in every 360 degree rotation of the bottom end relative to the top end the pin lodges in the groove putting the locking arrangement in the locked position.

10. The combination of claim 1, wherein the first part of the length adjustable mounting comprises a spindle nut which comprises the top end of the vane holder and wherein the second part of the length adjustable mounting comprises a threaded spindle element which comprises the bottom end of the vane holder and wherein the threaded spindle element and the spindle nut are rotatably interconnected.

11. The combination of claim 10, wherein a locking arrangement is provided between the top end and the bottom end of the vane holder which in a locked position prevents inadvertent rotation of the bottom end of the vane holder relative to the top end of the vane holder.

12. The combination of claim 11, wherein the locking arrangement comprises a vertically extending groove in the thread of the spindle element and a locking pin on the inner surface of the nut for co-operation in the groove such that at one point in every 360 degree rotation of the bottom end relative to the top end the pin lodges in the groove putting the locking arrangement in the locked position.

* * * * *